United States Patent [19]

Mead et al.

[11] 4,027,355

[45] June 7, 1977

[54] PNEUMATIC CLEANING MAT AND METHOD OF MAKING SAME

[76] Inventors: George N. J. Mead, 22 Emerald Acres, Dover, N.H. 03820; Philip R. Corneliusen, Black Pond Road, Hillsboro, N.H. 03244

[22] Filed: Jan. 27, 1975

[21] Appl. No.: 544,563

Related U.S. Application Data

[63] Continuation-in-part of Ser. No. 425,543, Dec. 17, 1973, abandoned.

[52] U.S. Cl. ..... 15/310; 15/316 R; 15/319

[51] Int. Cl.[2] ..... A47L 23/22; A47L 5/38

[58] Field of Search ..... 15/301, 303, 310, 311, 15/316 R, 317, 319

[56] References Cited

UNITED STATES PATENTS

| | | | |
|---|---|---|---|
| 3,165,773 | 1/1965 | Palpacelli | 15/310 |
| 3,786,531 | 1/1974 | Borg | 15/310 |

FOREIGN PATENTS OR APPLICATIONS

| | | | |
|---|---|---|---|
| 742,839 | 9/1966 | Canada | 15/303 |

*Primary Examiner*—Christopher K. Moore
*Attorney, Agent, or Firm*—Morse, Altman, Oates & Bello

[57] ABSTRACT

A mat is provided for placement at a doorway or other area where it is desired to provide a positive cleaning action of footwear worn by pedestrians. The mat is in the form of a flat, pressurized tank equipped with a plurality of closely spaced poppet valves distributed over the tread surface and which will release air jets when stepped upon. The air jets released by the poppet valves will blow debris such as dirt and snow from the soles of shoes, boots, etc., of the wearer as he steps on the mat. The tread surface of the mat preferably is in the form of a corrugated rubber ply or layer of bristles, for example, to collect dirt and other residue accumulated thereon as well as to protect the valves. The tank portion is connected to a compressed air system which maintains a predetermined pressure level by an automatic control system. Molding and machining operations are used in the manufacture of the tank.

10 Claims, 6 Drawing Figures

PNEUMATIC CLEANING MAT AND METHOD OF MAKING SAME

CROSS-REFERENCE TO RELATED APPLICATION

This application is a continuation-in-part of U.S. patent application Ser. No. 425,543 filed Dec. 17, 1973 and entitled "Pneumatic Cleaning Mat" and now abandoned.

BACKGROUND OF THE INVENTION

1. Field of the Invention

This invention relates generally to doormats and the like and more particularly is directed towards a new and improved pneumatic mat for automatically cleaning the soles of footwear of those walking on the mat. The invention also relates to a novel method for making the pneumatic mat.

2. Description of the Prior Art

Stores, restaurants, office buildings and other public facilities face constant problems in maintaining their premises in a reasonably clean condition. This task is particularly difficult during snowy and rainy weather because of snow, ice and water that is tracked in by pedestrians, shoppers, etc., entering the premises. While mats are frequently provided to alleviate this problem, they are only partially effective since a pedestrian seldom stops on the mat to thoroughly wipe his shoes or boots. In any event, such mats quickly become saturated with dirt, ice, water, snow, etc., and lose their effectiveness in a very short time.

Accordingly, it is an object of the present invention to provide an automatic doormat adapted to thoroughly and effectively clean by positive action the footwear of those walking on the mat. Another object of this invention is to provide a pneumatic doormat for automatically cleaning and drying footwear of pedestrians as they walk on the mat by releasing air jets directly against the soles of the shoes.

A further object of the invention is to provide a novel method for manufacturing a pneumatic doormat.

SUMMARY OF THE INVENTION

This invention features a pneumatic cleaning mat comprising a shallow, pressurized air tank formed with a plurality of restricted orifices distributed over the top wall thereof. A poppet valve is mounted in each orifice and provided with a stem protruding up through the orifice in position to be depressed when stepped upon to thereby open one or more valves. Release of air by opening the valves under a foot produces a number of air jets which impinge upon the sole of the shoes or boots of those stepping on the mat, removing a substantial portion of the dirt, snow, etc., that may be adhering thereto.

The mat includes a tread surface preferably in the form of corrugated stratum of resilient material adapted to collect dirt, ice, etc., removed from the shoes by the air jets. The tread surface supports the shoe in a plane above the plane of the valve orifices to prevent blockage of the orifices by the shoe. A pressure-control system is provided for automatically maintaining a pedetermined pressure level within the mat.

The tank may be fabricated by stamping, molding or otherwise forming the top wall thereof with a plurality of hollow protuberances and then machining off the tips of the protuberances to form the orifices.

DETAILED DESCRIPTION OF THE PREFERRED EMBODIMENTS

Figure 5:
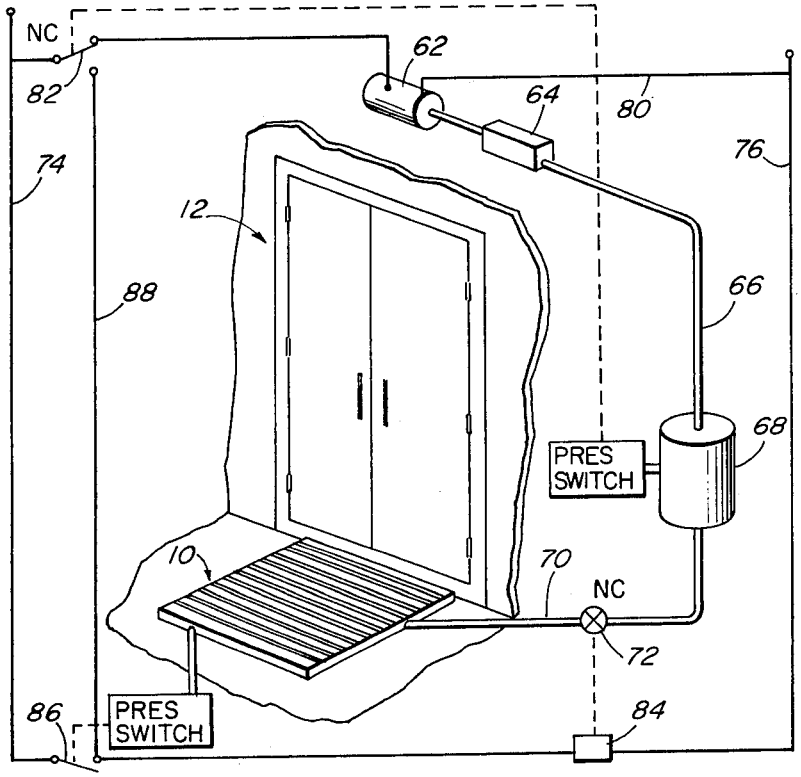
FIG. 5 is a view in perspective, somewhat schematic, illustrating the mat and pressurizing system, and, FIG. 6 is a detailed sectional view in side elevation showing another modification of the invention.

Referring now to the drawings, the reference character 10 generally indicates a pneumatic mat which typically may be used at the entrance to a doorway 12 as suggested in FIG. 5 and is especially useful in a public building such as a store, apartment, office building, and the like, where heavy pedestrian traffic is commonly encountered. Such traffic flow normally generates maintenance problems requiring frequent cleaning of entire floor areas. The problem becomes particularly troublesome during stormy weather when pedestrians track in water, ice and snow which tend to accumulate. This not only soils the floor but also may present a danger to pedestrians due to the slippery conditions resulting therefrom. The mat 10 is adapted to alleviate this problem by providing automatic dynamic cleaning of the shoes, boots, etc., of pedestrians walking across the mat.

The mat 10 is generally organized about a shallow pressurized air tank 14 comprised of a flat bottom wall 16 and a top wall 18 in generally spaced parallel relation to the bottom wall and marginally sealed thereto along a flange 20 extending about the edges of the tank. The tank 14 may be fabricated from a variety of materials although for ease and economy in production a thermoplastic material such as ABS, for example, may be employed using vacuum forming techniques. Obviously, a wide variety of other materials may be employed to advantage such as stamped sheet steel, aluminum and the like. Many other plastic materials may also be utilized.

In any event, the top wall 18 of the tank 14 is formed with a plurality of rather closely spaced orifices 22 lying in a first horizontal plane and distributed perhaps 1 inch apart in a repeat pattern with each orifice being closed by means of a poppet valve 24 mounted therein. The poppet valve is formed with an upright stem 26 protruding through the top of the mat and adapted to be depressed by a person walking across the mat. The valves 24 are normally kept closed by the air pressure within the tank 14 with each poppet valve raised into a closed position shown in FIG. 2. However, when a stem 26 is depressed by a shoe or boot, for example, the valve will open releasing a jet of air through the annular clearance between the stem and the orifice, a jet of air being directed upwardly against the sole of the shoe or boot providing a dynamic cleaning and drying action.

In the preferred form of the invention, as illustrated, the top wall 18 is formed with a plurality of protuberances or bosses 28 at each valve position. Each boss, when initially formed, is closed at its upper end as shown in the left-hand side of FIG. 2. The orifice for that valve position is formed by slicing off the top of the boss by passing the top wall through a milling machine or the like as suggested by a milling cutter 29 in FIG. 2, the boss 28 is formed with upper and lower cylindrical sections 30 and 32 respectively, the lower section being slightly larger in diameter than the upper section and the two sections being connected by a frustro-conical shoulder 34 forming a valve seat.

The poppet valve 24 is comprised of the stem 26 which protrudes through the opening 22 and an enlarged base portion 36. The stem 26 is of a diameter slightly smaller than the upper cylindrical section 30 in the boss to provide clearance for air to escape when the valve is open. The base portion 36 has a diameter greater than that of the upper section 30 but smaller than the lower section 32. The poppet valve is also formed with an annular groove 38 at the base of the stem 26 and the top of the base portion 36 and in which is mounted an O-ring 40 adapted to seal against the seat 34 when the poppet valve is in a raised, closed position. In practice, the upper cylindrical section 30 is relatively long to provide guiding action for the stem and prevent the stem from being tilted should the stem be kicked sideways rather than being stepped down upon.

When the valve is depressed, the air is released in a high pressure jet cleaning the sole and lower portion of the shoe or boot.

As will appear more fully below, the mat structure is provided with a tread surface that maintains the shoe sole in a plane above the plane of the valve openings to prevent the shoe from sealing off the valve openings when stepping on the valves. When the person moves along removing his foot from the stem, the movable poppet valve will be forced upwardly under the action of the air pressure within the tank sealing the O-ring against the conical seat thereby closing the valve and stopping the air flow. If desired, light springs may be added to the poppet valves urging the valves normally upwards to their closed positions to facilitate the closing action without interfering to a substantial extent with the opening action when stepped upon.

Figure 2:
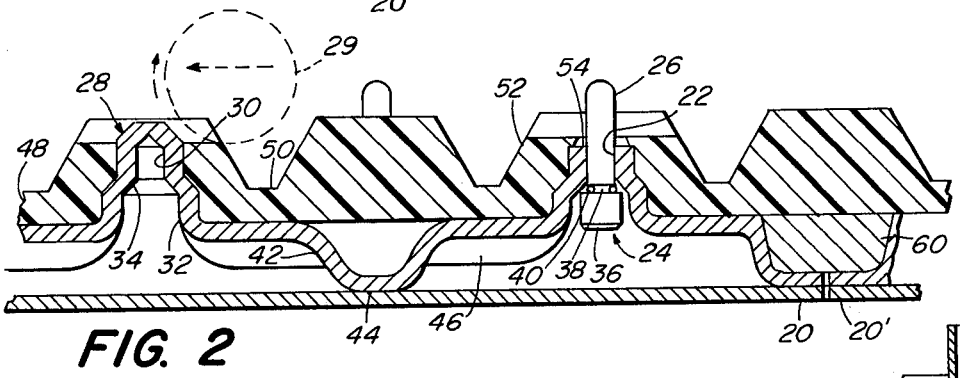
FIG. 2 is a sectional detailed view in side elevation of the mat partially completed.

In order to maintain spacing between the top and bottom walls of the tank under the weight of pedestrian traffic, the top wall 18 is formed with a plurality of indents 42 having a depth corresponding with the spacing between the top and bottom walls. Each indent preferably is formed with a relatively flat bottom portion 44 which rests against the inner surface of the bottom wall 16 as best shown in FIG. 2. The flat portions 44 may be cemented to the inner face of the wall 16 and provide structural strength to retain pressure and support the weight the people walking upon the mat. At the same time, the indents are spaced apart to allow air flow throughout the interior of the tank.

Figure 3:
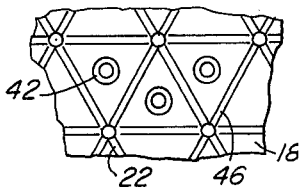
FIG. 3 is a fragmentary top plan view showing details of construction.

While the pattern in which the valves and indents are arranged is not critical, one satisfactory arrangement is that of an equilateral triangular layout best shown in FIG. 3. In FIG. 3 it will be noted that the valve openings 22 form an equilateral triangle in a repeat pattern with an indent 42 positioned centrally within each triangle. Also it is to be noted in FIG. 3 that the top wall is further reinforced by means of female ribs or channels 46 formed integral with the top wall 18 and extending between each valve opening 22. The depth of the reinforcing rib is approximately half the depth of the tank as best shown in FIG. 2 so as not to interfere with air circulation while at the time providing reinforcement to the wall.

Figure 1:
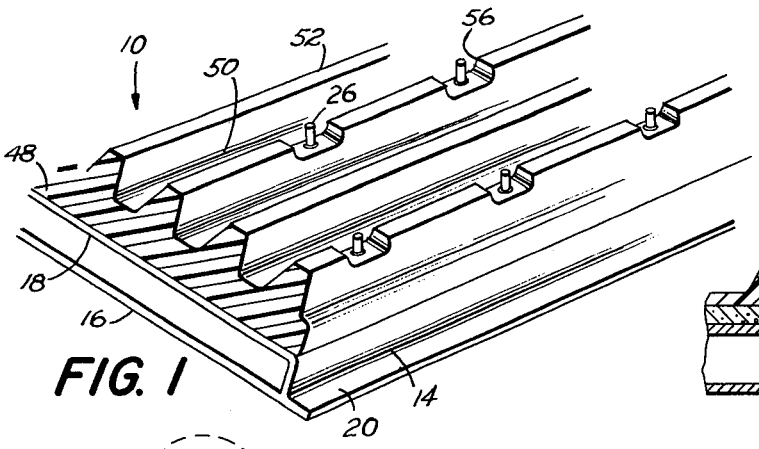
FIG. 1 is a fragmentary perspective view of a pneumatic cleaning mat made according to the invention.

Disposed on top of the flat, pressurized tank 14 is a tread layer 48 providing a wear surface for the tank. The layer 48 in the illustrated embodiment is a flexible mat, typically rubber, and formed with a plurality of longitudinal corrugations defining spaced grooves 50 and ribs 52 the tops of which lie in a second plane to support the soles of shoes above the nozzle openings 22 which lie in the first plane below the second plane. In addition to providing a wear surface for the tank, the layer 48 serves to protect the valves and also collect and store dirt, etc., in the grooves 50 removed by the action of the air jets. The bases of the grooves lie in a third plane below the first and second planes to store dirt removed above. The layer 48 is formed with a plurality of openings 54 in register with the valve stems 26 which project therethrough when the layer 48 is in normal position. The openings 54 preferably are formed in the ribs 52 spaced along the tops of the ribs, as shown. The mat and tank are placed on the floor of the doorway in such a fashion that the ribs 52 are oriented transversely to the line of traffic. The ribs also serve to keep the bottom surface of the shoe sole in one plane above the level of the air nozzles which are in a lower plane and thereby prevent the shoe from shutting off the air blasts. It will be seen in FIG. 1 that the tops of the ribs 52 are cut away at 56 about the stems 26. The function of the cutaway portions is to insure that air released by a valve will not be blocked by a shoe sole stepping directly above the valve.

Figure 4:
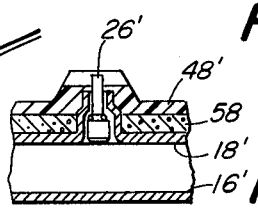
FIG. 4 is a sectional detail view in side elevation showing a modification of the invention.

The lower portion of the ribs 52 and valves protect the nozzles leaving only a short section of the rounded top ends of the stems exposed to traffic. The stems may project above the tops of the ribs for some installations whereby the pedestrian steps directly down on the stems to actuate the valve. In such case, the tread layer 48 is of a relatively firm rubber or other material. In other installations, particularly next to a door that swings across the top of the mat, it may be desirable to keep the tops of the stems flush with the tops of the ribs 52. In such an installation, a relatively soft, resilient cushion layer 58 is added between the tank 14' and the layer 48' as shown in FIG. 4. The layer 48 is adapted to yield easily under the weight of the pedestrian so that when a pedestrian steps on a valve location it will depress the mat 48' downwardly compressing the layer 58 and allowing the stems to be depressed to open the valves.

In place of the corrugated rubber mat 48, a bristled mat having a relatively thick density may be employed with the fibers generally extended upright. In any event, the tread surface is removable so that cleaning is facilitated and replacement of worn mats is simplified. In practice, the tanks 14 may be fabricated in modules, with several modules located at each cleaning station. As shown in FIG. 2 adjacent modules are located in side-by-side butting relationship with a batt 60 or the like serving to fill the void defined between adjacent flanges 20 and 20' for each module. The batt provides a continuous flat surface across the tops of the modules on which the layer 48 rests in overlapping relation. Fabrication of the tanks having modular construction allow for flexibility in arranging and laying out the cleaning station and also facilitates manufacture and replacement of components.

Figure 6:
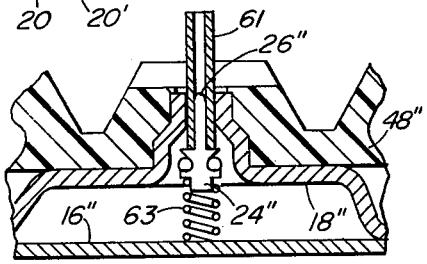

Referring now to FIG. 6 of the drawings, there is illustrated a further modification of the invention and in this embodiment flexible extensions are added to the valve stems 26 to provide a yielding portion and prevent breakage of the valve by persons who may brush their shoes on the tread surface. Preferably, the extension is in the form of a tube 61 attached to the valve stem. The tube may be made from PVC, for example, and will move with the valve which may be made of nylon. A light spring 63 is provided to urge the valve into a normally closed position.

Referring now more particularly to FIG. 5, there is illustrated the pressurizing and control system for the pneumatic mat. The system includes a motor 62 driving an air compressor 64 which discharges through a conduit 66 to a storage tank 68. Typically, the tank 68 stores a quantity of compressed air at a level between 10 to 25 psi. From the storage tank 68 a conduit 70 connects to the pneumatic mat 10 through a solenoid actuated valve 72. The controller circuitry includes a pair of leads 74 and 76 connected to a suitable power source, typically 110 volts AC. The leads 74 and 76 are connected by leads 78 and 80 to the compressor motor 62 with the lead 78 being interrupted by means of a pressure-actuated switch 82. The switch 82 responds to the pressure in the storage tank 68 and is adapted to close the contact with the lead 78 and start the motor 62 when pressure in the storage tank 68 drops to 10 psi, for example. These valves are only typical and the pressure range may be altered as desired.

The lead 76 is in circuit with a coil 84 for the solenoid actuated valve 72 and connects to the lead 74 through another pressure actuated switch 86. The switch 86 responds to the air pressure within the mat 10 and is set to close the switch 86 whenever the pressure within the mat drops below 7 psi, for example. The switch 86 opens when operating pressure within the mat is reached.

The circuit operates as follows: In the starting mode leads 74 and 76 are energized by connecting them to the power supply and in this mode the switch 82 will be in the position shown in FIG. 6 by which the motor compessor 62, 64 is energized thereby charging the storage tank 68 to maximum pressure. When the tank reaches maximum pressure, the pressure switch 82 will open thereby shutting off the compressor. The switch 82 will then close the contact to a lead 88 which connects to the pressure switch 86. This will complete a circuit to the coil 84 opening the valve 72 and dumping air into the pneumatic mat. This surge of pressurized air will close the poppet valves sealing them and then the pressure build-up in the mat will close the pressure switch 86 which holds the solenoid valve 72 open.

As long as the pressure in the pneumatic mat remains above 7 psi, the system is in the operating mode where the storage tank pressure switch controls the compressor to maintain pressure between 10 to 25 psi.

While the invention has been described with particular reference to the illustrated embodiments, numerous modifications will appear to those skilled in the art. For example, while the valves 24 have been disclosed as an assembly of a valve body and O-ring (as well as an extension 61) the parts may be made in one piece, if desired. Also, instead of a separate corrugated mat, the top wall of the tank may be formed with integral corrugations, coated with rubber or the like and the tops milled off to form valve openings as described.

Having thus described the invention what we claim and desire to obtain by Letters Patent of the United States is:

1. A pneumatic cleaning mat, comprising a. a generally flat, shallow tank having closely spaced top and bottom walls, b. said top wall being formed with a plurality of spaced openings therein in a first horizontal plane, c. a valve movably mounted in each of said openings for normally closing said openings, d. a tread stratum disposed over said top wall and formed with a plurality of openings in registration with said top wall openings, said stratum including a tread surface disposed in a second horizontal plane above said first plane, e. means connecting said tank to a source of compressed air for pressurizing said tank, and, f. each of said valves including individual actuating means disposed in spaced relation over said top wall, g. said actuating means being responsive to applied pressure whereby the valves directly under a foot applied to said mat will open to release jets of compressed air against the sole of said foot, h. said actuating means including an upright flexible stem connected to each valve and extending through said top wall and said stratum openings, i. the upper end of said stem being substantially flush with the upper surface of said stratum and a second stratum of relatively soft resilient material disposed between the first stratum and said top wall and adapted to yield under applied weight.

2. A pneumatic cleaning mat according to claim 1 wherein said stratum is resilient.

3. A pneumatic cleaning mat according to claim 1 including control means connected to said compressed air source and to said tank for maintaining a substantially constant pressure level within said tank.

4. A pneumatic cleaning mat according to claim 3 wherein said control means includes an air compressor, a high pressure storage chamber connected to said compressor and to said tank, a solenoid actuated valve connected between said chamber and said tank and pressure responsive switches connected to said chamber and said tank for selectively operating said compressor and said solenoid actuated valve within predetermined pressure ranges.

5. A pneumatic cleaning mat, comprising a. a generally flat, shallow tank having closely spaced top and bottom walls, b. said top wall being formed with a plurality of spaced openings therein in a first horizontal plane, c. a valve movably mounted in each of said openings for normally closing said openings, d. a tread stratum disposed over said top wall and formed with a plurality of openings in registration with said top wall openings, said stratum including a tread surface disposed in a second horizontal plane above said first plane, e. means connecting said tank to a source of compressed air for pressurizing said tank, and, f. each of said valves including individual actuating means disposed in spaced relation over said top wall, g. said actuating means being responsive to applied pressure whereby the valves directly under a foot applied to said mat will open to release jets of compressed air against the sole of said foot, h. said stratum being formed with a plurality of ribs and grooves over the top surfaces thereof, the bases of said grooves lying in a third horizontal plane below said first and second planes to store debris therein, said stratum openings being formed through said ribs.

6. A pneumatic cleaning mat according to claim 5 wherein said ribs are recessed about said openings and said stems.

7. A pneumatic cleaning mat, comprising a. a generally flat, shallow tank having closely spaced top and bottom walls, b. said top wall being formed with a plurality of spaced openings therein in a first horizontal plane, c. a valve movably mounted in each of said openings for normally closing said openings, d. a tread stratum disposed over said top wall and formed with a plurality of openings in registration with said top wall openings, said stratum including a tread surface disposed in a second horizontal plane above said first plane, e. means connecting said tank to a source of compressed air for pressurizing said tank, and, f. each of said valves including individual actuating means disposed in spaced relation over said top wall, g. said actuating means being responsive to applied pressure whereby the valves directly under a foot applied to said mat will open to release jets of compressed air against the sole of said foot, h. said top wall being formed with a plurality of indents and protuberances in spaced relation therein, said top wall openings being formed at the apices of said protuberances, each of said indents bearing against said bottom wall.

8. A pneumatic mat according to claim 7 wherein each of said protuberances defines upper and lower cylindrical sections to receive said valve, the upper section of said protuberance being of a diameter smaller than the lower section, each of said valves being formed with an enlarged cylindrical base portion and a narrow cylindrical stem mounted for reciprocation in said upper and lower sections.

9. A pneumatic cleaning mat according to claim 8 including a resilient O-ring mounted at the top of said base portion and the lower end of said stem.

10. A pneumatic cleaning mat according to claim 7 wherein said top wall is formed with a plurality of integral channels having a depth less than the distance between said top and bottom walls.

* * * * *